United States Patent [19]

Hsieh

[11] Patent Number: 4,799,610

[45] Date of Patent: Jan. 24, 1989

[54] CARRYING HOLDER

[76] Inventor: Wu H. Hsieh, No. 178, Chun-shan Second Road, Lu Chou Hsiang, Taipei Hsien, Taiwan

[21] Appl. No.: 167,579

[22] Filed: Mar. 14, 1988

[51] Int. Cl.[4] ..... G10G 5/00

[52] U.S. Cl. ..... 224/266; 224/201; 224/268; 224/910; 84/421; 403/61

[58] Field of Search ..... 224/197, 201, 242, 254, 224/255, 265, 266, 268, 271, 272, 910; 84/421; 403/59, 61, 98, 116

[56] References Cited

U.S. PATENT DOCUMENTS

| | | | |
|---|---|---|---|
| 1,303,846 | 5/1919 | Blauvelt | 403/61 |
| 1,403,431 | 1/1922 | McElhone | 224/255 |
| 1,755,641 | 4/1930 | Foulke | 2/44 |
| 2,712,779 | 2/1951 | Tolcher | 224/265 |
| 3,696,826 | 10/1972 | Gruzalski | 2/44 |
| 3,767,095 | 10/1973 | Jones | 224/907 |
| 4,387,839 | 6/1983 | Dranchak | 224/265 |
| 4,450,993 | 5/1984 | Ephraim | 224/265 |

*Primary Examiner*—Henry J. Recla
*Assistant Examiner*—Edward Donovan
*Attorney, Agent, or Firm*—Keaty & Keaty

[57] ABSTRACT

A carrying holder of a musical instrument comprising a "T" bar, a pair of shoulder bars, a belly plate and fastening means. The pair of shoulder bars are fastened to a lateral plate of the "T" bar by bolts. Note that the fastening portions of the lateral plate are formed by two longitudinally aligned seats installed on two sides of the lateral plate. Each of the grooves has an appropriate number of semi-circular holes set separately so that bolts can be bolted through the semi-circular holes. On the corresponding positions of the shoulder bars, a hole and an arc-like slots are installed which make the shoulder bar is angularly adjustable about a bolt.

2 Claims, 5 Drawing Sheets

CARRYING HOLDER

BACKGROUND OF THE INVENTION

This invention relates to a carrying holder, especially to an improved carrying holder of musical instruments, such as a bass drum, a quad tom, snare drum, etc., in which the shoulder bars are convenient to assemble and are angularly adjustable.

The carrying holder of the present invention is especially designed for a member of a marching band, such as a military band, for carrying a musical instrument. The prior art, as shown in FIG. 5, is composed of a "T" bar 1', a pair of shoulder bars 2', a belly plate 3' and fastening means 4'. A lateral plate 11' of the "T" bar 1' includes a plurality of holes 111' aligned in lateral direction on each end thereof which are used for receiving bolts 112' to fix the pair of shoulder bars 2' thereon. The shoulder bars 2' also have an appropriate number of threaded holes 21' for engagement with the bolts 112'. The fastening means 4' fixed on the belly plate 3' consist of two hooks which hook the musical instrument to prevent the musical instrument from dropping down. In usage, the shoulder bars 2' are put on the shoulders of a person. For maximum adjustability, applications, the holes 111' of the lateral plate 11' of the "T" bar 1' are aligned in a lateral direction so that the distance between the pair of shoulder bars 2' can be adjusted by changing the bolting positions of the shoulder bars with the lateral plate 11'.

However, there is some inconvenience and time-wasting when changing the positions of the shoulder bars 2 since the shoulder bars 2 are "fixed" at separate holes 111' of the lateral plate 11'. It is necessary to unthread the bolts 112' from the holes 111', then to thread the bolts 112' into other desired holes, which will waste much time. Therefore, to eliminate the disadvantages mentioned above, the carrying holder of the present invention incorporates grooves comprising a plurality of semi-circular holes.

SUMMARY OF THE INVENTION

A primary object of the present invention is to provide a carrying holder wherein the shoulder bars are fixed on the lateral plate of the "T" bar by means of bolting slots comprising a plurality of semi-circular holes which make assembling and adjusting the positions of the shoulder bars convenient and time-saving since the bolts are slideable in the bolting slots for choosing an appropriate hole, but not rethreaded in the appropriate hole, to fix the shoulder bars.

A second object of the present invention is to provide a carrying holder in which the shoulder bars includes two bolting portions and which have an arc-like slot so as to permit the shoulder bar to be pivotably inclined as desired to the bolt threaded therein.

Another object of the present invention is to provide a carrying holder wherein the belly plate 3' has two inclined sides which incline from outside to the central portion (i.e., to a longitudinal plate of the "T" bar) with the height of the central portion larger than that of each outside so that such construction makes the user comfortable during long-distance walking since the belly plate is supported by the abdominal region of an user.

Further objectives and advantages of the present invention will become apparent as the following description proceeds, and the features of novelty which characterize the invention will be pointed out with particularity in the claims annexed to and forming a part of the present invention.

DETAILED DESCRIPTION OF THE PREFERRED EMBODIMENT

Figure 1:
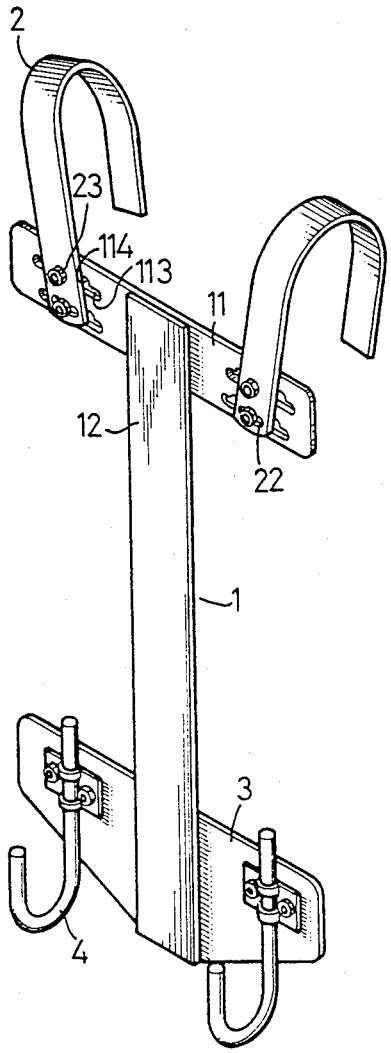
FIG. 1 is a perspective view of the carrying holder of the present invention.
Figure 2:
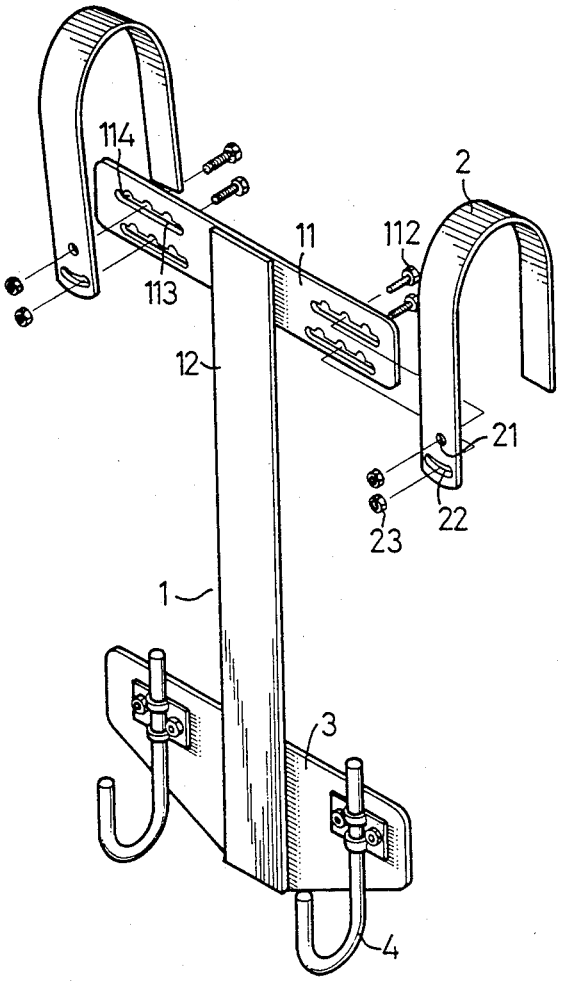
FIG. 2 is a view of the present invention wherein the shoulder bars and the lateral plate are exploded for showing the assembly thereof.

Referring to FIG. 1 and FIG. 2, it can be seen that the carrying holder of the present invention comprises a "T" bar 1, a pair of shoulder bars 2, a belly plate 3 and a pair of fastening means 4. The shoulder bars 2 are bolted on a lateral plate 11 of the "T" bar 1 by bolts 112.

On each end of the lateral plate 11, two longitudinally aligned arc-like slots 113 are installed. An appropriate number of semi-circular holes 114 are set separately on the grooves 113. Please note that the longitudinal width of the bolting slots 113 and the width formed by the semi-circular hole 114 combined with the grooves 113 are appropriate so that the bolts 112 are permitted to slide in the slots 113 so that an appropriate semi-circular hole is selectable as desired to bolt the shoulder bars 2 to the lateral plate 11.

Figure 3:
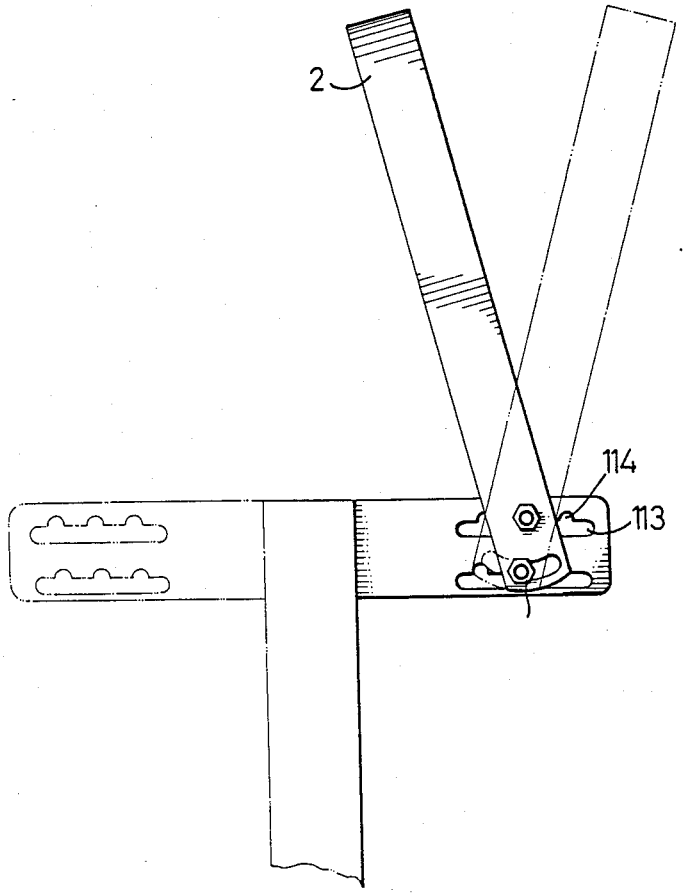
FIG. 3 is an enlarged sectional view of the assembling relationship of the shoulder bar and the lateral plate of the "T" bar which shows the angular adjustability of the present invention.

It is also noted that the fastening end of each shoulder bar 2 includes two bolting portions: a hole 21 and an arc-like slot 22 from the upper portion to the lower portion. The arc-like configuration of the arc-like bolting slot 22 is set for angular adjustment; i.e., the shoulder bar 2 is angularly adjustable about a pivot so that bolts are insertable through on the hole 21 of the shoulder bar 2 as necessary when the shoulder bar 2 is used to hang on the shoulder of a user. As shown in FIG. 3, the shoulder bar 2 is adjustable rightward or leftward for various applications.

Figure 4:
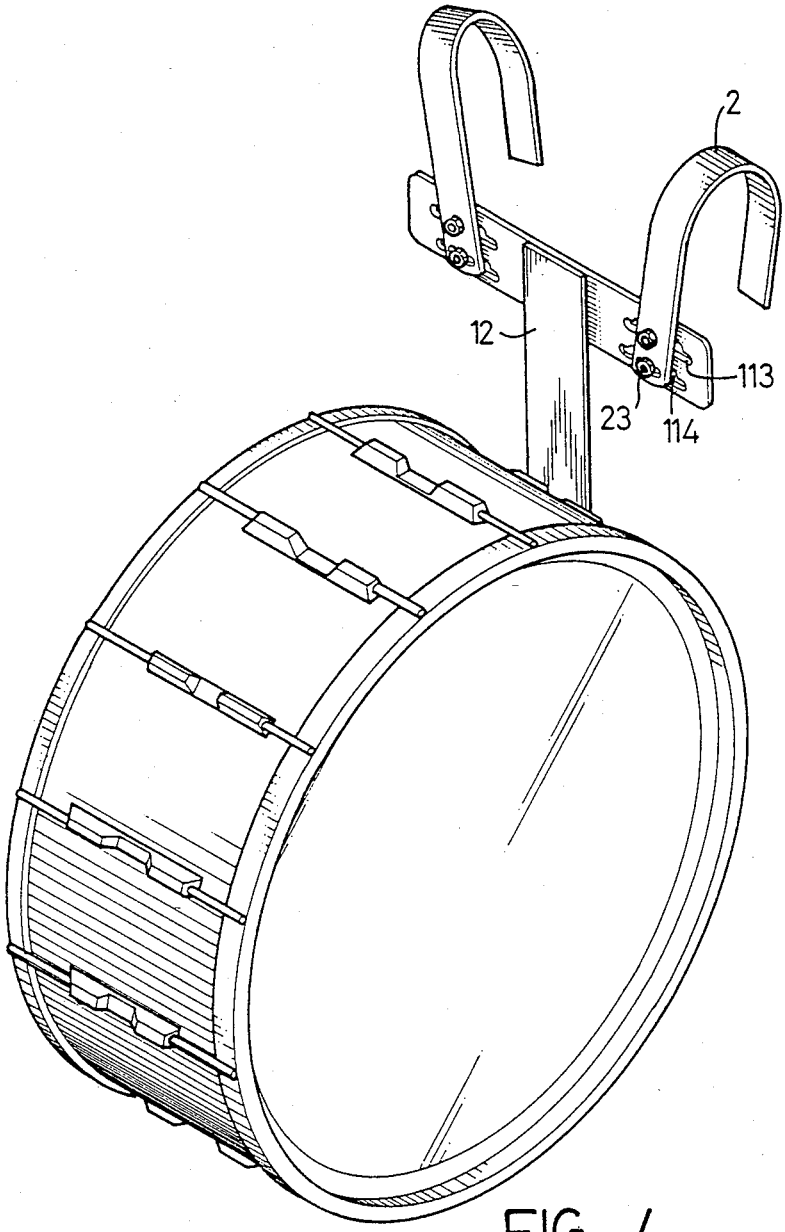
FIG. 4 is a working view of the present invention.
Figure 5:
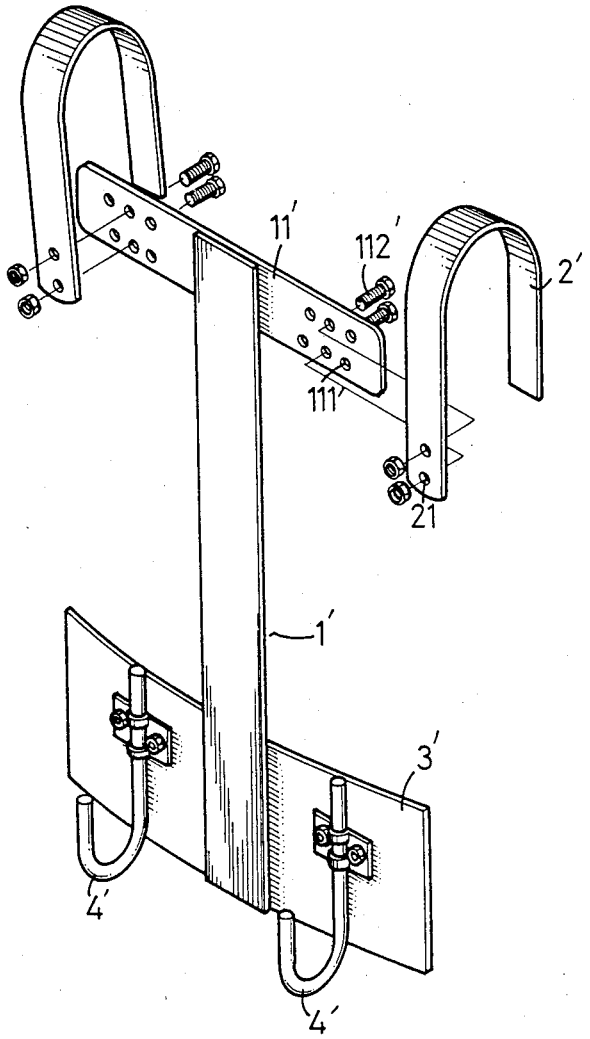
FIG. 5 PRIOR ART
FIG. 5 is a prior art view of a carrying holder.

Now referring to FIG. 4, it can be seen that an embodiment of the present invention as the carrying holder is applied to carrying a bass drum. In usage, the bass drum is fastened by the fastening means 4 and the shoulder bars 2 are put on the shoulders of the user. To provide comfort and efficiency for the user in a long-time walking, the belly plate 3 is constructed to reduce the contact area of the belly plate 3 with the abdomen of the user and therefore, to decrease the uncomfortable feeling resulting from the pressure produced by the belly plate 3.

It can be seen that, from FIG. 2, the lower portion of the belly plate 3 is inclined from two sides to a central portion (such as a longitudinal plate 12) thereof with the length of the central portion larger than that of each side. It is obvious that the contact area is decreased and each of the outer lower corners of the belly plate have a rounded obtuse angular construction so that the belly plate is more comfortable while marching.

As mentioned above, the carrying holder of the present invention is designed especially for a marching band (i.e., wherein it is necessary to play music while walking and carrying musical instruments). It provides a feature of adjusting the position of the shoulder bars rapidly; i.e., it is only necessary to loose nuts 23 (shown in FIG. 2) and to move the bolts 112 in the slots 113 and to chose a desired semi-circular hole and then to bolt to fasten the shoulder bars 2 to the lateral plate 11, but not to unthread the bolts and rebolt them on desired holes.

According to the preferred embodiments mentioned above, it is to be understood that various modifications thereof will become apparent to those skilled in the art upon reading this specification. Therefore, it is to be understood that the invention disclosed herein is intended to cover such modifications as fall within the scope of the appended claims.

I claim:

1. A carrying holder of a musical instrument comprising a "T" bar (1) having an elongated central plate section attached perpendicularly to the first end of said central plate section, a pair of shoulder bars having a lower fastening end and an upper hook shaped portion (2), a belly plate (3) attached perpendicularly to the opposite end of said central plate section and fastening means on said belly plate for holding said musical instrument (4), characterized in that:

said pair of shoulder bars (2) comprising elongated rigid members each adapted to the positioned over a shoulder of the wearer each has a hole and an arc-like slot (22) aligned from an upper position to a lower position on said fastening end thereof; and said "T" bar (1) has two longitudinally extending and parallel aligned slots aligned grooves (113) on each end thereof said slots further including an appropriate number of semi-circular holes (114) adjacent to an intersecting one side of each of said slots, said hole and arc-like slot in each respective shoulder bar being in alignment with said slots in each respective end of said center plate, bolt means slidable through each respective aligned holes and slots in said shoulder bars and lateral plate adjustably fastening said pair of shoulder bars (2) to said lateral plate (11) by bolting said bolts on a desired one of said semi-circular holes (114) and pivot said shoulder bars about said holes and arc-like slots.

2. A carrying holder of a musical instrument as claimed in claim 1, wherein said belly plate (3) has a construction with two sides on a lower portion thereof inclining to a central portion thereof and with a length of said central portion larger than that of each of said two sides.

* * * * *